US009403384B2

(12) United States Patent
Nakata et al.

(10) Patent No.: US 9,403,384 B2
(45) Date of Patent: Aug. 2, 2016

(54) RECORDING APPARATUS

(71) Applicant: SEIKO EPSON CORPORATION, Tokyo (JP)

(72) Inventors: Satoshi Nakata, Matsumoto (JP); Kazumasa Harada, Matsumoto (JP); Yoshiyuki Okazawa, Shiojiri (JP)

(73) Assignee: Seiko Epson Corporation, Toyko (JP)

( * ) Notice: Subject to any disclaimer, the term of this patent is extended or adjusted under 35 U.S.C. 154(b) by 0 days.

(21) Appl. No.: 14/630,025

(22) Filed: Feb. 24, 2015

(65) Prior Publication Data

US 2015/0239269 A1 Aug. 27, 2015

(30) Foreign Application Priority Data

Feb. 25, 2014 (JP) ..... 2014-034381

(51) Int. Cl.
*B41J 11/00* (2006.01)

(52) U.S. Cl.
CPC ..... *B41J 11/0095* (2013.01); *B41J 11/0065* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,367,642 | B2 | 5/2008 | Ouchi et al. | |
| 2006/0269342 | A1 * | 11/2006 | Yoshida et al. | 400/62 |
| 2013/0222458 | A1 * | 8/2013 | Yatsunami | 347/16 |

FOREIGN PATENT DOCUMENTS

JP 2006-272711 10/2006

* cited by examiner

*Primary Examiner* — Huan Tran
(74) *Attorney, Agent, or Firm* — Workman Nydegger

(57) ABSTRACT

A recording apparatus includes a carriage that includes a recording head performing recording on a recording medium, and an edge detection unit detecting an edge of the recording medium, and is movable in a predetermined direction, in which, in a state in which the carriage is positioned at a predetermined position, the edge detection unit is positioned in a passing region of the recording medium in the movement direction of the carriage, and the predetermined position is a home position of the carriage.

12 Claims, 13 Drawing Sheets

RECORDING APPARATUS

BACKGROUND

1. Technical Field

The present invention relates to a recording apparatus represented by a facsimile, a printer, or the like.

2. Related Art

A recording apparatus represented by a facsimile or a printer, particularly a serial-type recording apparatus that performs recording while the carriage provided with a recording head moves in a predetermined direction may be configured so that an optical sensor configured from a light emitting unit and a light receiving unit is provided on a carriage, the presence of a sheet or the edge position of the sheet is detected based on the intensity of light that the light receiving unit has received (for example, JP-A-2006-272711).

In recent years, there is demand for further size reductions of printers. In particular, for mobile-type printers which are assumed to be carried by a user, there is demand for still further size reductions.

When focusing on the horizontal width dimensions of the printer, the horizontal width dimensions are generally determined by the width of the movement region of the carriage. The width of the movement region of the carriage is influenced by the operation width for the carriage necessary for detecting the side edge of the sheet by the optical sensor, in addition to the sheet width.

In the recording apparatus disclosed in the above-described JP-A-2006-272711 or another recording apparatus of the related art, even though the apparatus is configured so as to detect the sheet edge with an optical sensor, the arrangement of the optical sensor is not devised from the viewpoint of size reductions.

SUMMARY

An advantage of some aspects of the invention is to provide a recording apparatus configured to detect the sheet edge position taking size reductions of the apparatus into account.

According to a first aspect of the invention, there is provided a recording apparatus including a carriage that includes a recording head performing recording on a recording medium, and an edge detection unit detecting an edge of the recording medium, and is movable in a predetermined direction, in which, in a state in which the carriage is positioned at a predetermined position, the edge detection unit is positioned in a passing region of the recording medium in the movement direction of the carriage, and the predetermined position is a home position of the carriage.

In this case, since the edge detection unit is positioned within the passing region of the recording medium in the movement direction of the carriage in a state in which the carriage is positioned at the predetermined position, that is, the home position, the home position of the carriage is near (close to) the passing region of the recording medium. Accordingly, the horizontal width dimension (dimension in the movement direction of the carriage) of the apparatus is suppressed, and it is possible for the size of the apparatus to be reduced.

According to a second aspect of the invention, there is provided a recording apparatus including a carriage that includes a recording head performing recording on a recording medium, and an edge detection unit detecting an edge of the recording medium, and is movable in a predetermined direction; and a cap unit that caps the recording head and is provided outside a passing region of the recording medium in the movement direction of the carriage, in which in a state in which the carriage is positioned at a predetermined position, the edge detection unit is positioned in the passing region of the recording medium in the movement direction of the carriage, and the predetermined position is a position at which the recording head is capped by the cap unit.

In this case, since the edge detection unit is positioned within the passing region of the recording medium in the movement direction of the carriage in a state in which the carriage is positioned at the predetermined position, that is, the position (below, referred to as a capping position) at which the head is capped by the capping unit, the capping position of the carriage is near (close to) the passing region of the recording medium. Accordingly, the horizontal width dimension (dimension in the movement direction of the carriage) of the apparatus is suppressed, and it is possible for the size of the apparatus to be reduced.

According to a third aspect of the invention, there is provided a recording apparatus including a carriage that includes a recording head performing recording on a recording medium, and an edge detection unit detecting an edge of the recording medium, and is movable in a predetermined direction, in which, in a state in which the carriage is positioned at a predetermined position, the edge detection unit is positioned in a passing region of the recording medium in the movement direction of the carriage, and the predetermined position is an end portion position on one side of the movable region of the carriage.

In this case, since the edge detection unit is positioned within the passing region of the recording medium in the movement direction of the carriage, in a state in which the carriage is positioned at the predetermined position, that is, the end portion position on one side of the region in which the carriage is movable, the end portion position on one side of the movable range of the carriage is near (close to) the passing region of the recording medium. Accordingly, the horizontal width dimension (dimension in the movement direction of the carriage) of the apparatus is suppressed, and it is possible for the size of the apparatus to be reduced.

According to a fourth aspect of the invention, it is preferable that the recording apparatus further includes a transport unit that transports the recording medium; and a control unit that controls the transport unit and the carriage, in which the control unit is able to execute a leading edge detection mode for detecting a leading edge of the recording medium by transporting the recording medium until the leading edge of the recording medium passes through a position facing the edge detection unit, in a state in which the carriage is stopped at the predetermined position during leading edge-positioning of the recording medium.

In this case, since the control unit that controls the transport unit and the carriage is able to execute the leading edge detection mode that detects the leading edge of the recording medium by transporting the recording medium until the leading edge of the recording medium passes through the position facing the edge detection unit in a state in which the carriage is stopped at the predetermined position during leading edge-positioning of the recording medium, it is possible to detect passing of the leading edge of the recording medium with the carriage stopped at the predetermined position, and it is possible for lowering of the recording throughput to be suppressed without the carriage being moved from the predetermined position to the detection position.

According to a fifth aspect of the invention, it is preferable that the control unit, in a case where the leading edge detection mode is executed, does not execute borderless recording that performs recording without white space on the end portion of the recording medium.

In this case, since the control unit does not execute the borderless recording that performs recording without white space on the end portion of the recording medium in a case where the leading edge detection mode is executed, even in cases where only the side edge of one side of the recording medium is detected, or not detected, it is possible for a suitable recording quality to be secured.

According to a sixth aspect of the invention, it is preferable that, after the leading edge detection mode is executed, the control unit executes a side edge detection mode for detecting the side edge of one side of the recording medium by the carriage being moved to an opposite side to the predetermined position side until the edge detection unit is separated from the region of the recording medium.

In this case, since the control unit executes the side edge detection mode for detecting the side edge of one side of the recording medium by the carriage being moved to an opposite side to the predetermined position side until the edge detection unit is separated from the region of the recording medium after the leading edge detection mode is executed, it is possible for shifting of the recording position to be suppressed by detecting the side edge on the one side, and it is possible for better recording results to be obtained.

According to a seventh aspect of the invention, it is preferable that a signal line cable that connects the control unit and the recording head extends from the side surface of the carriage on the opposite side to the predetermined position side, and the control unit performs first recording on the recording medium with the recording head when the carriage is moved toward the predetermined position after execution of the side edge detection mode.

In a case where the signal line cable that connects the control unit and the recording head extends from the side surface of the carriage on the opposite side to the predetermined position side, if the carriage is positioned at the predetermined position, the signal line cable is positioned on a position above the transport region of the recording medium. Accordingly, in this case, it is difficult to perform jam processing tasks in a case in which a jam occurs in the transport path of the recording medium and there is concern of a breakdown occurring by the user touching the signal line cable. Meanwhile, when the carriage is positioned at the end portion on the opposite side (below, referred to as "opposite side end portion position") to the predetermined position, the signal line cable retreats from the position above the transport region of the recording medium.

There is concern of the recording head coming into contact with the side edge of the recording medium as the side edge of the recording medium is bent upward and a jam arising as a result. That is, jams according to the movement of the carriage easily occur when the recording head moves from the outside of the recording medium to the inside during first recording on the recording medium.

In a case in which the first recording on the recording medium is performed when the carriage moves from the predetermined position to the opposite side end portion position, if a jam occurs during the recording, the carriage is able to perform only one of stopping at the position or returning to the predetermined position. Thus, because the signal line cable is positioned on the position above the transport region of the recording medium during jam processing tasks by the user, there is concern of the above-described problem arising.

However, the control unit performs first recording on the recording medium with the recording head when the carriage is moved (from the opposite side end portion position) to the predetermined position side after the side edge detection mode is executed. That is, since the first recording on the recording medium is performed during movement of the carriage from the opposite side end portion position to the predetermined position, it is possible for the above-described problem to be avoided.

According to an eighth aspect of the invention, it is preferable that the recording apparatus further includes a feeding portion that feeds the recording medium to the recording head side, in which the feeding portion includes a first edge guide that guides the side edge of the recording medium on the predetermined position side in a direction that intersects a feeding direction of the recording medium, and a second edge guide that guides the side edge of the recording medium on an opposite side to the predetermined position side, and in which the first edge guide is provided to be movable to the second edge guide side until the passing region of the recording medium is separated from the arrangement position of the edge detection unit in a state in which the carriage is positioned at the predetermined position.

In this case, since the first edge guide that guides the side edge of the recording medium on the predetermined position side is movable to the second edge guide side until the passing region of the recording medium is separated from the arrangement position of the edge detection unit in a state in which the carriage is positioned at the predetermined position, it is possible to detect the side edge of the recording medium on the predetermined position side with the edge detection unit through the first edge guide being moved. That is, since it is possible to detect the side edge on both sides of the recording medium, shifting of the recording position is more reliably suppressed, and it is possible for a better recording result to be obtained. In particular, during the borderless recording that performs recording without white space on the end portion of the recording medium, an excellent recording result is obtained with suppression of shifting of the recording position.

According to a ninth aspect of the invention, it is preferable that the second edge guide is provided to be able to advance and retreat with respect to the first edge guide, and the first edge guide is provided to be movable in accordance with a movement of the second edge guide in a direction toward the second edge guide with a predetermined guide position as a boundary when the second edge guide is moved toward the first edge guide side.

In this case, since the first edge guide moves in accordance with a movement of the second edge guide, the operability for the user is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, embodiments of the invention are described with reference to the drawings. Like configurations in each embodiment have the like references applied thereto, description thereof will be made only in the first embodiment, and description of the configurations will not be repeated in subsequent embodiments.

Figure 1:
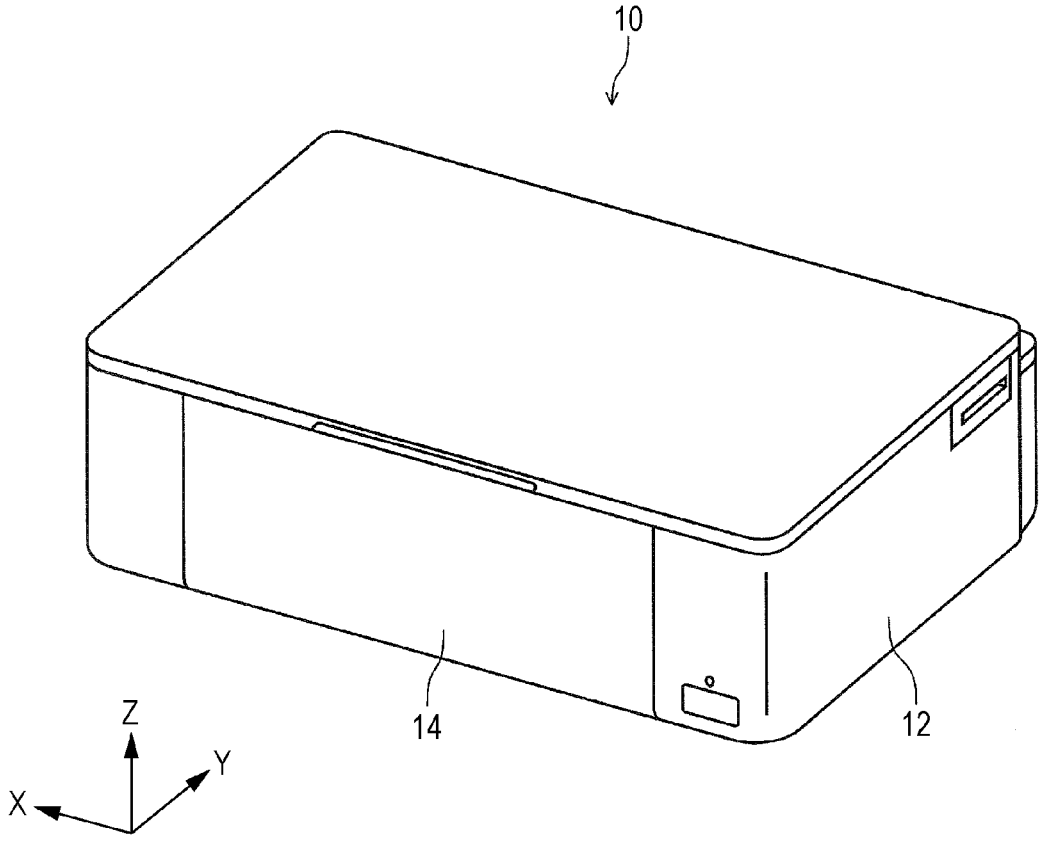
FIG. 1 is a perspective view illustrating the appearance of a printer according to the invention.
Figure 2:
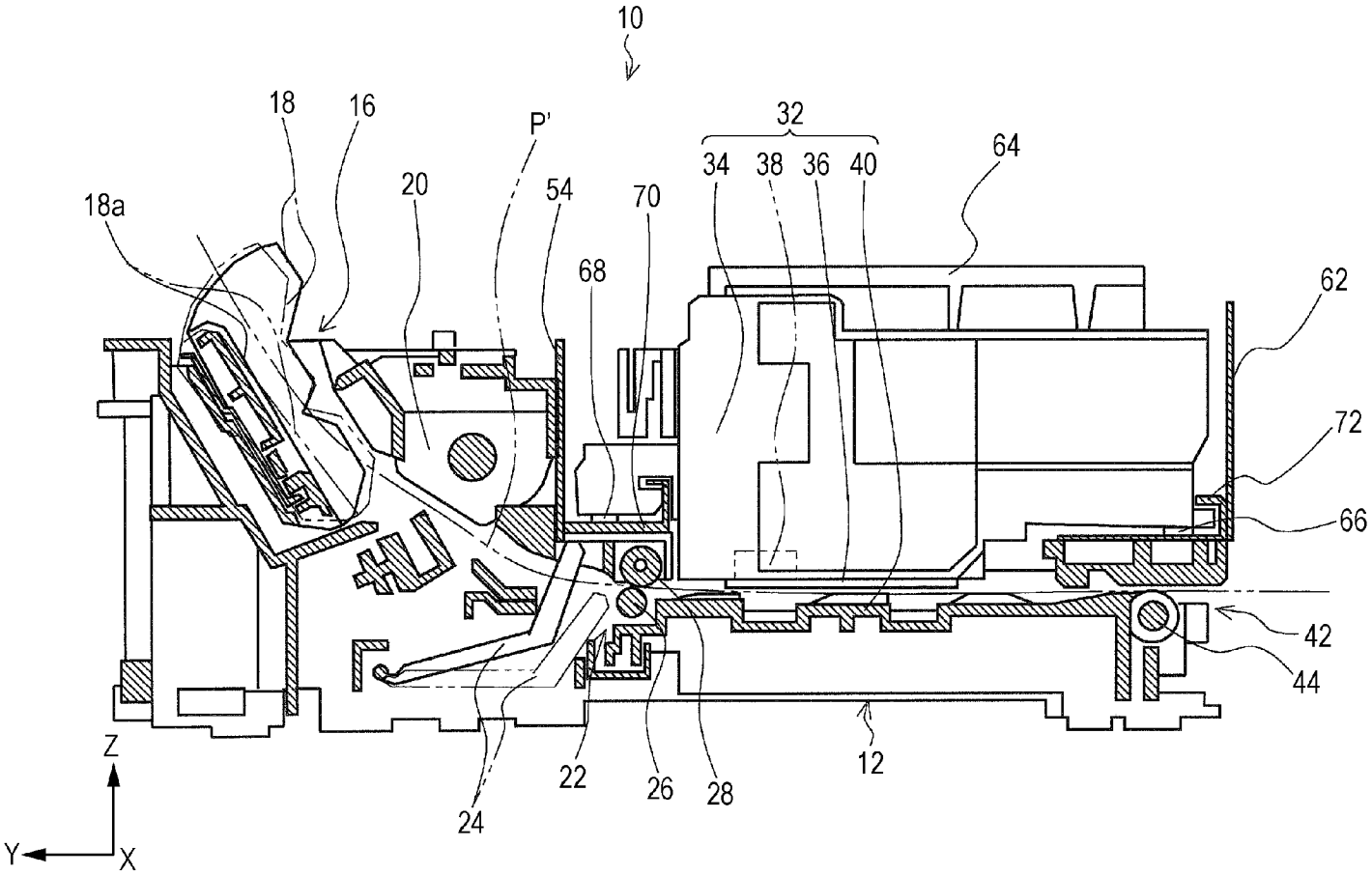
FIG. 2 is a side cross-sectional view showing a sheet transport path of the printer according to the invention.
Figure 3:
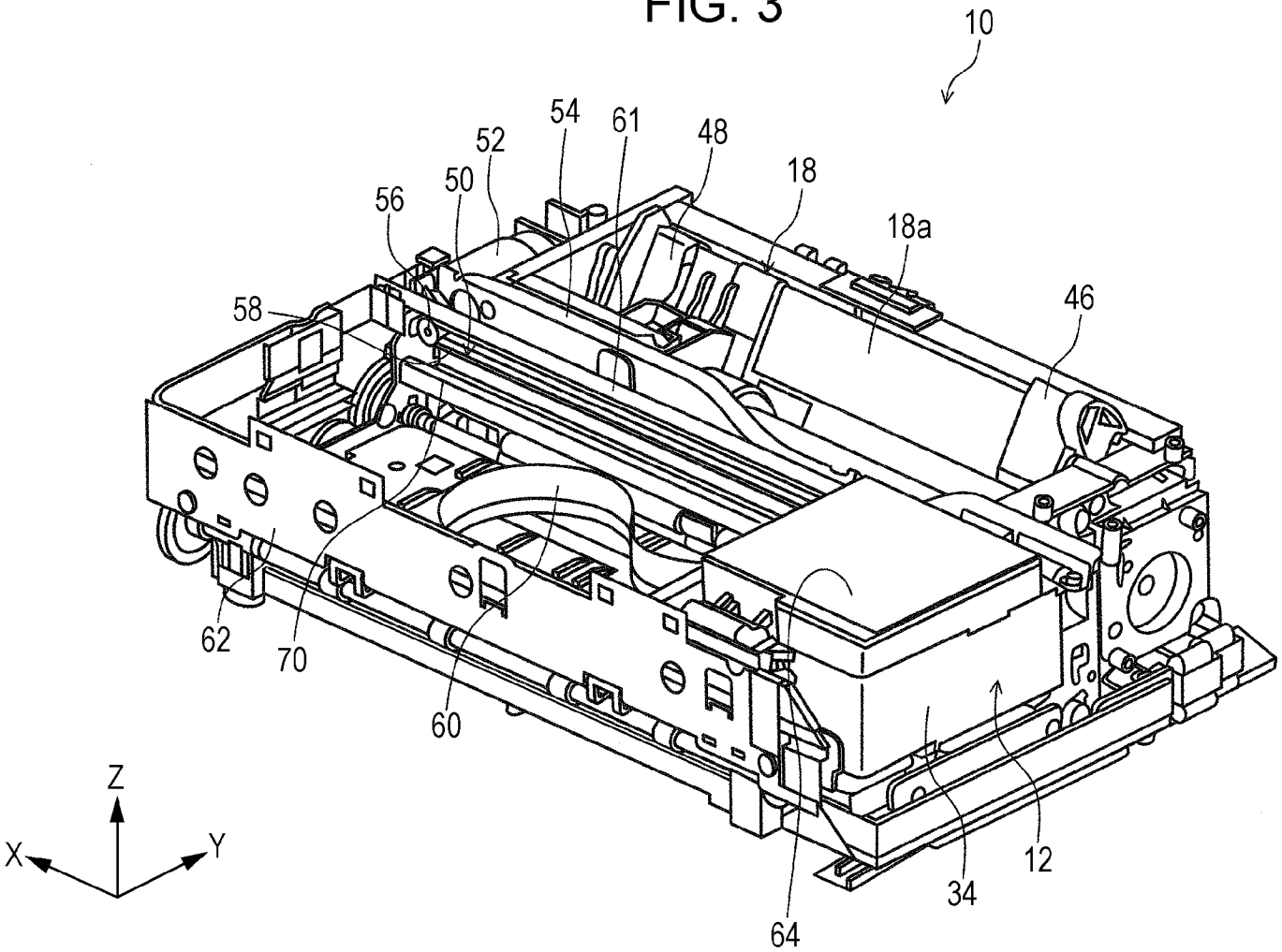
FIG. 3 is a perspective view of the apparatus main body of the printer according to the invention.
Figure 4:
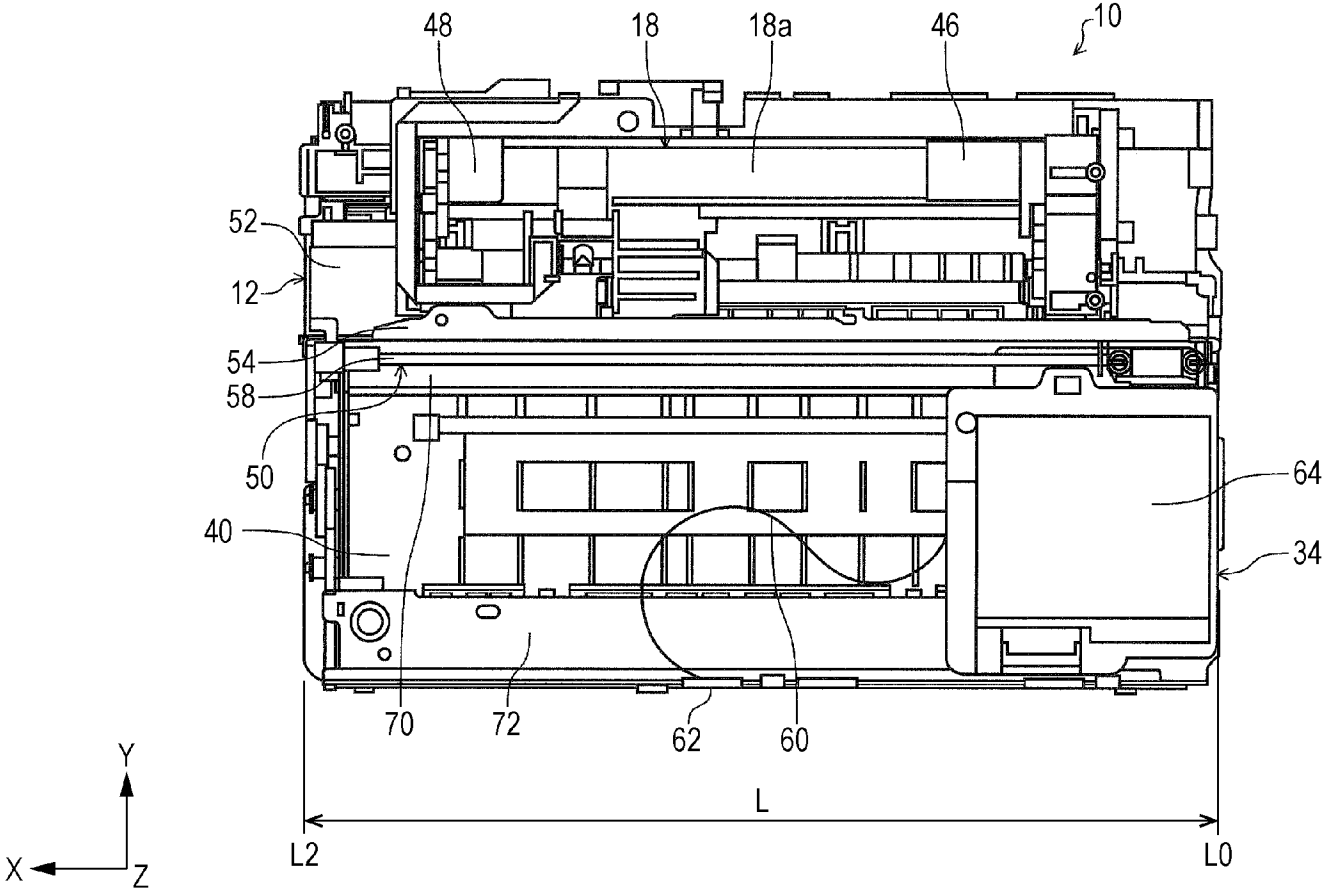
FIG. 4 is a plan view of the apparatus main body of the printer according to the invention.
Figure 5:
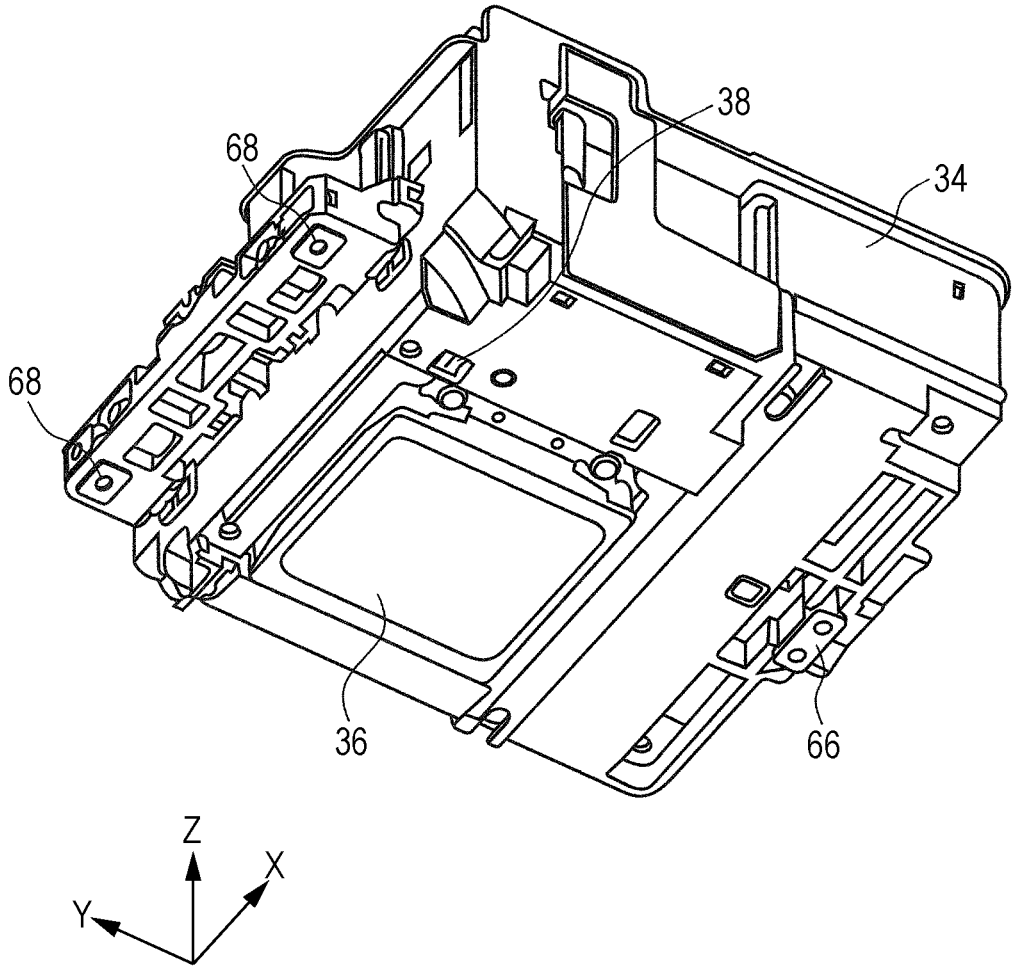
FIG. 5 is a perspective view of the lower surface of a carriage according to the invention.

FIG. 1 is a perspective view of a printer according to the aspect of the invention, FIG. 2 is a side cross-sectional view showing the paper transport path of the printer of the invention, FIG. 3 is a perspective view showing the apparatus main body of the printer according to the invention, FIG. 4 is a plan view showing the main body of the printer according to the invention, and FIG. 5 is a perspective view showing the lower surface of the carriage according to the invention.

Figure 6:
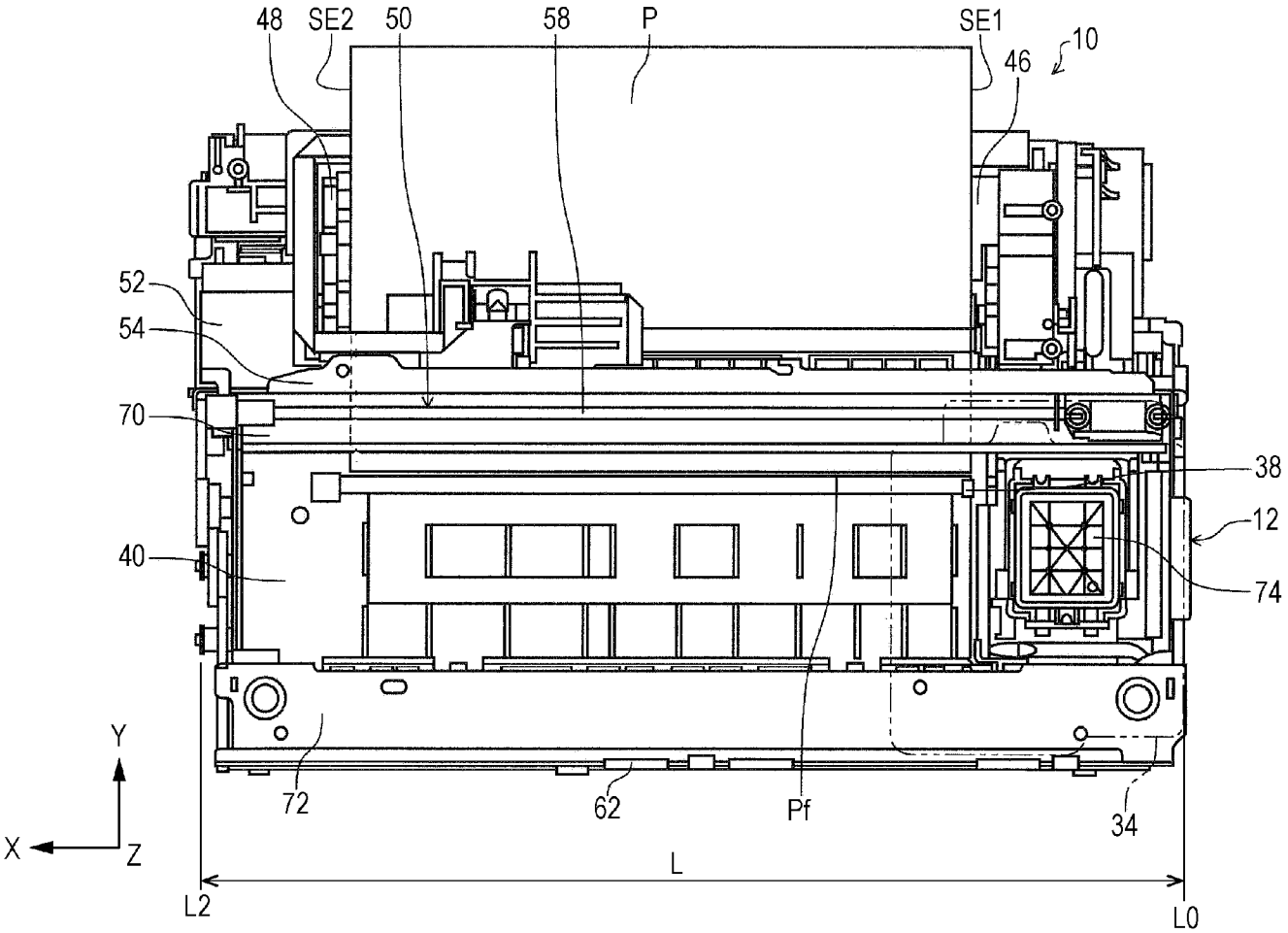
FIG. 6 is a plan view showing a state in which the leading edge of the sheet is positioned on the upstream side of the edge detection unit in a sheet feeding state.
Figure 7:
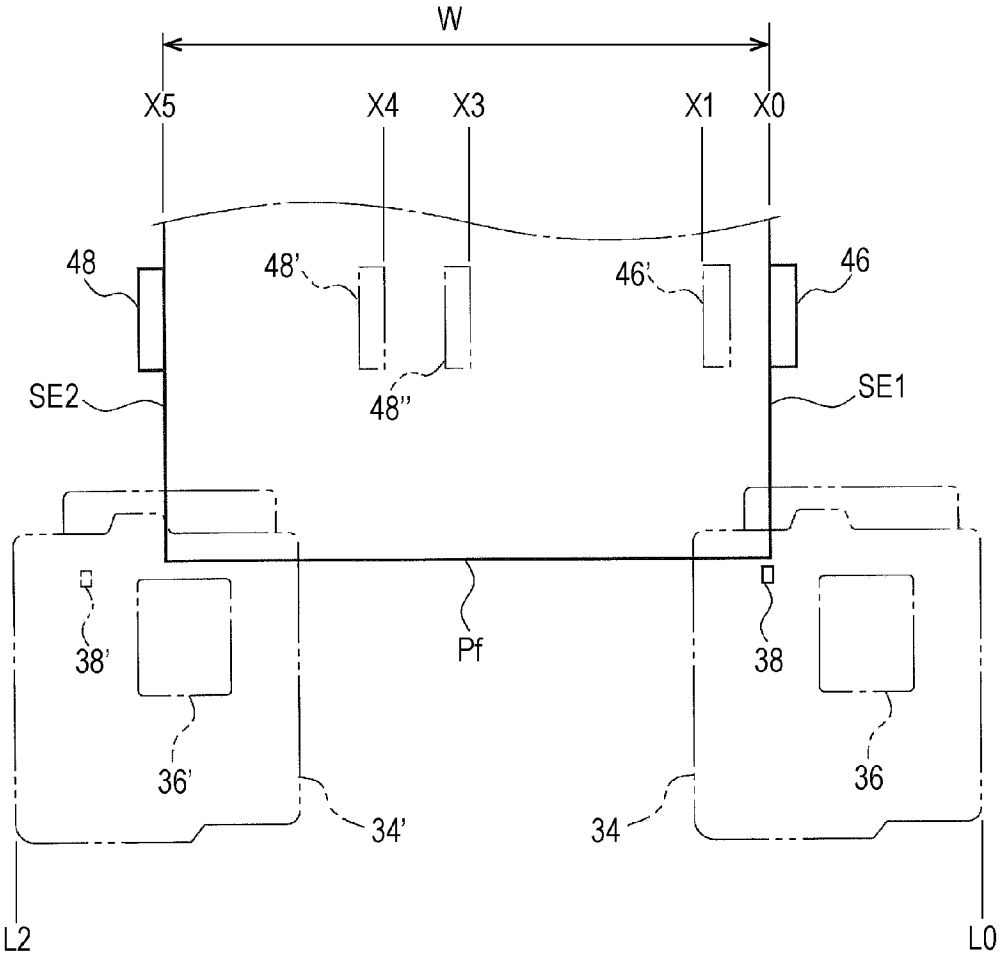
FIG. 7 is a drawing schematically showing the positional relationship between the edge guide, sheet, carriage, and edge detection unit (the leading edge of the sheet is positioned on the upstream side of the edge detection unit).
Figure 8:
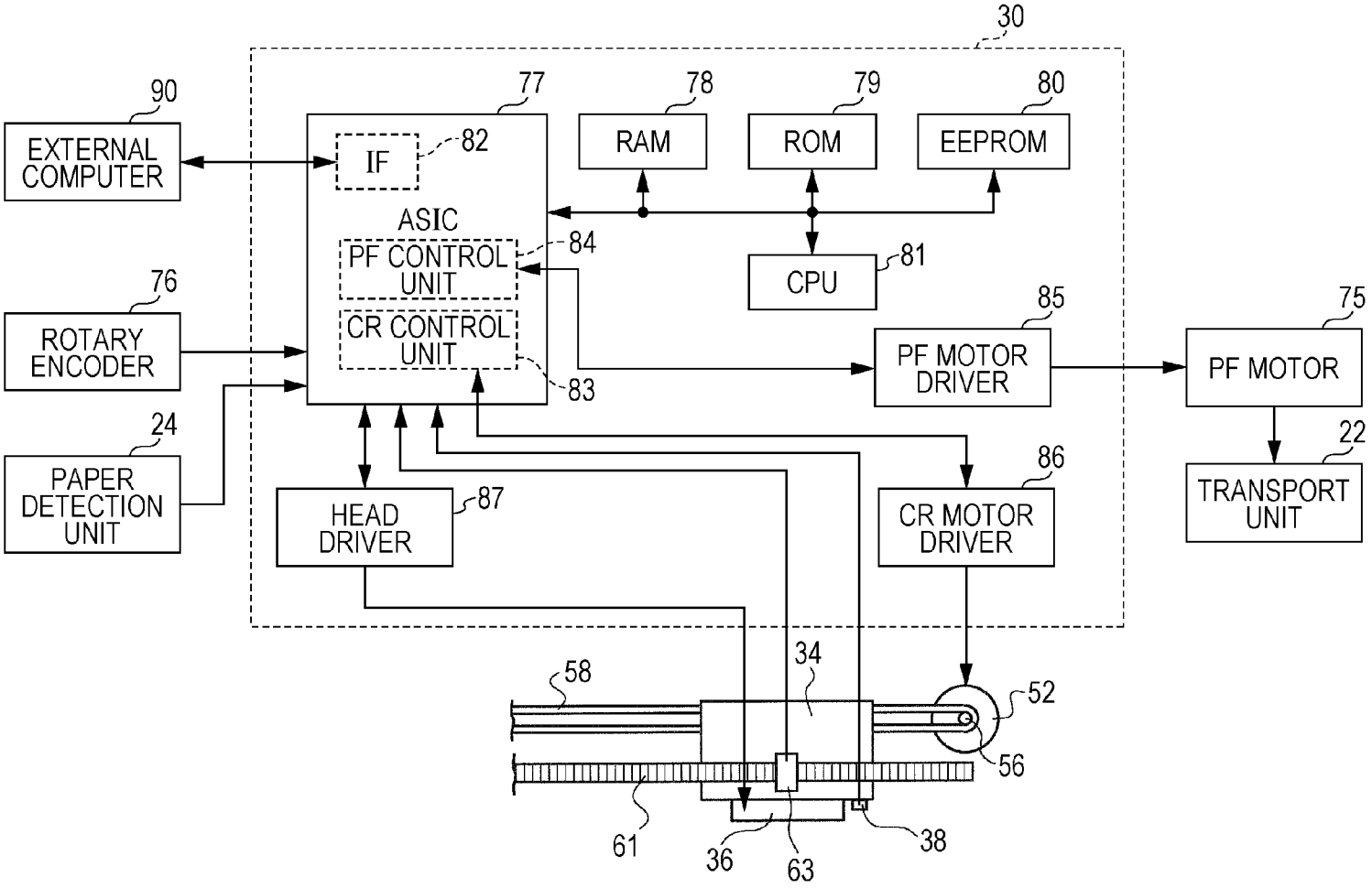
FIG. 8 is a block diagram showing a control system of the printer according to the invention.
Figure 9:
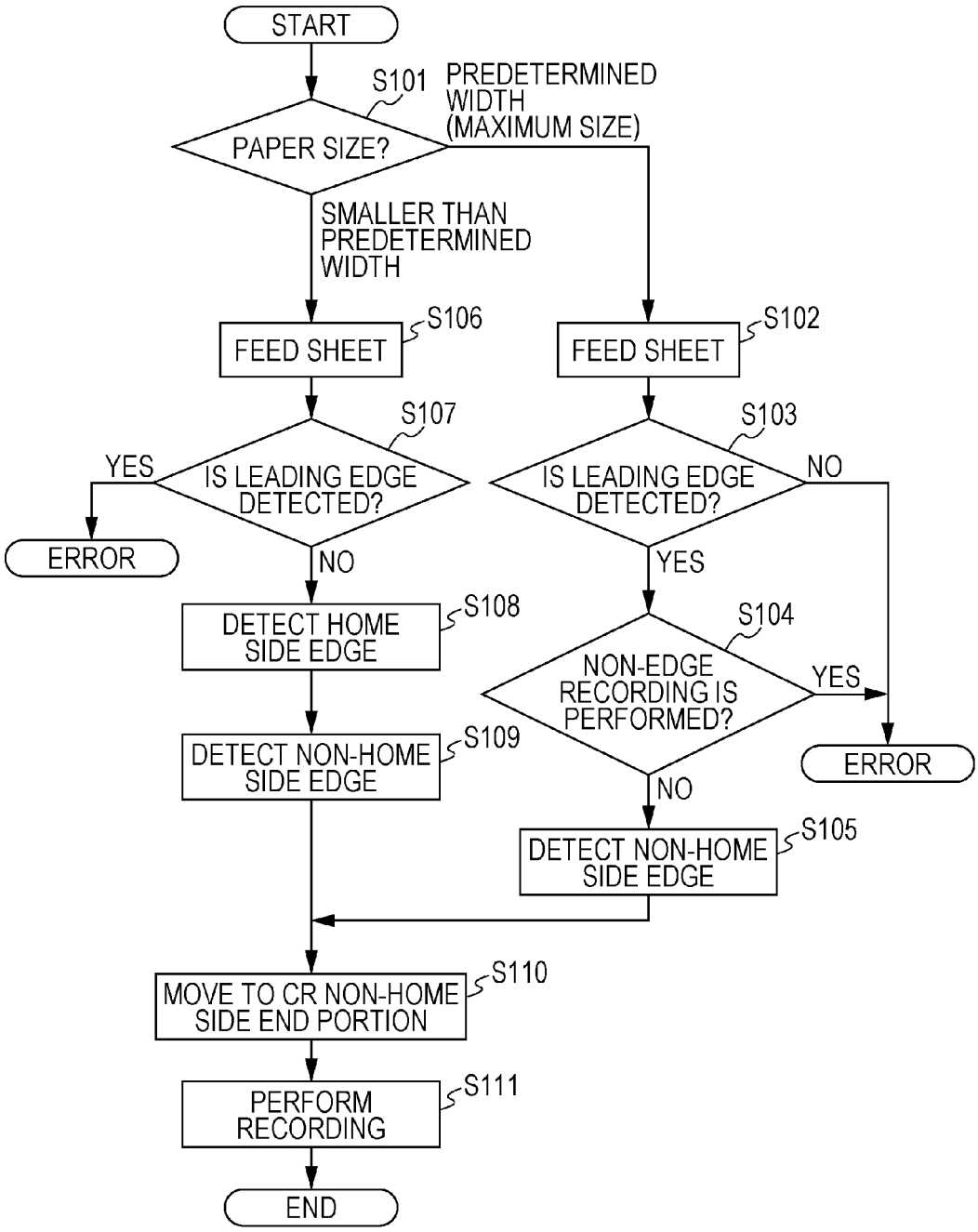
FIG. 9 is a flowchart of a recording execution operation of the printer according to the invention.
Figure 10:
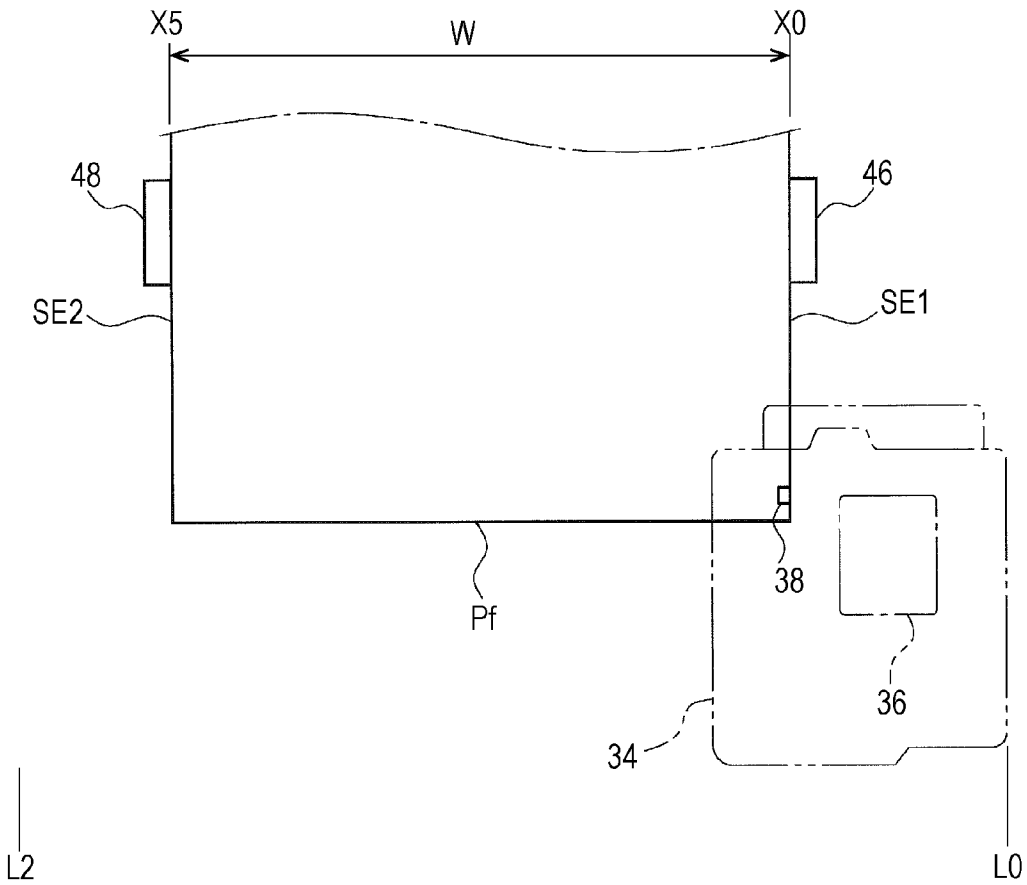
FIG. 10 is a drawing schematically showing the positional relationship between the edge guide, sheet, carriage, and edge detection unit (the leading edge of the sheet is positioned on the downstream side of the edge detection unit).
Figure 11:
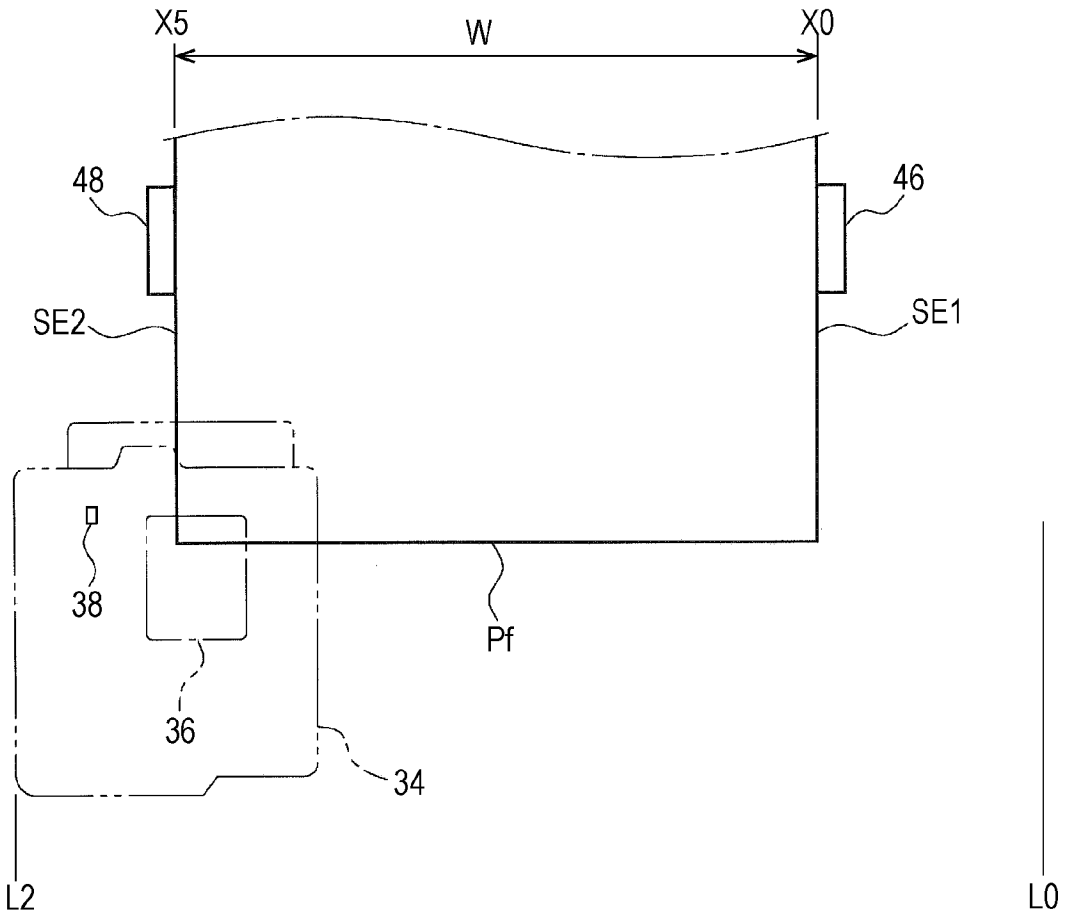
FIG. 11 is a drawing schematically showing the positional relationship between the edge guide, sheet, carriage, and edge detection unit (the leading edge of the sheet is positioned on the downstream side of the edge detection unit).
Figure 12:
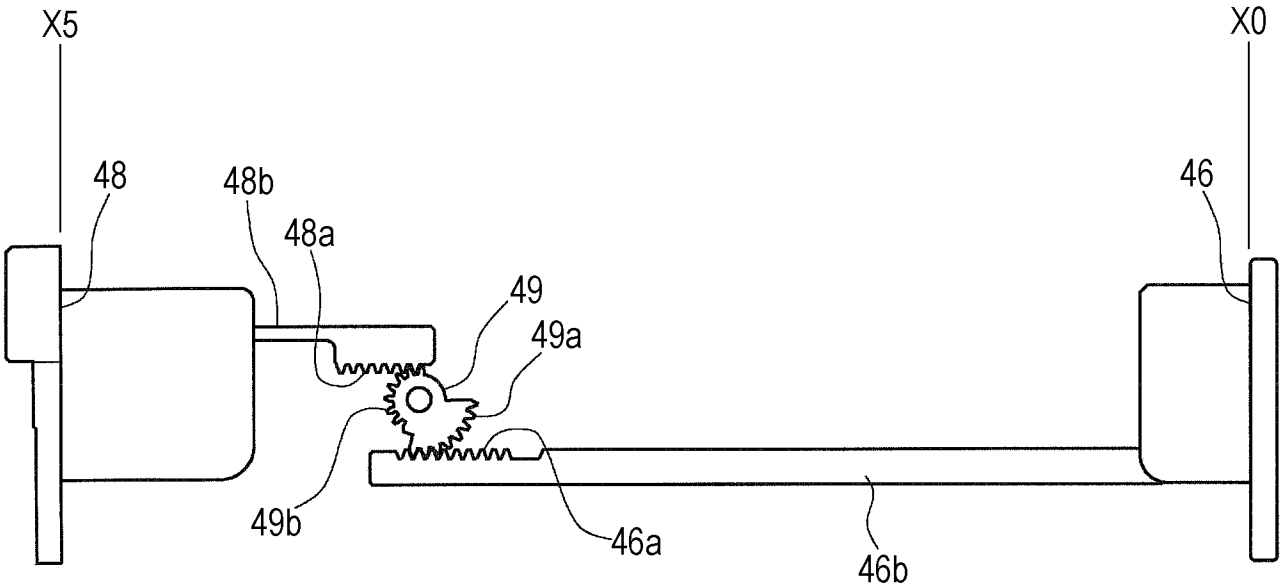
FIG. 12 is a plan view of a rack and pinion mechanism with which the first and second edge guides are interlocked.

FIG. 6 is a plan view showing a state in which the leading edge of the sheet is positioned on the upstream side of the edge detection unit in a sheet feeding state, FIGS. 7, 10, and 11 are drawings schematically showing the positional relationship between the edge guide, sheet, carriage, and edge detection unit, FIG. 8 is a block diagram showing the control system of the printer according to the invention, and FIG. 9 is a flowchart of the recording execution operation of the printer according to the invention. FIG. 12 is a plan view of a rack and pinion mechanism with which the first and second edge guides are interlocked.

In the X-Y-Z coordinate system shown in each diagram, the X direction indicates the scanning direction of the recording head, the Y direction the depth direction and sheet transport direction of the recording apparatus, and the Z direction the direction changing the distance (gap) between the recording head and the sheet, that is, the height direction of the apparatus. In each diagram, the −Y direction is set to the front surface side of the apparatus, and the +Y direction is set as the rear surface side of the apparatus.

Outline of Printer

The constituent elements of the ink jet printer 10 (below, referred to as "printer 10") will be described as an example of the recording apparatus with reference to FIGS. 1, 2 and 9. The printer 10 as shown in FIG. 1 is provided with an apparatus main body 12 and a cover 14.

The cover 14 is rotatably attached to that apparatus main body 12 on the front surface of the apparatus main body 12. The cover 14 is able to adopt an opened posture (not shown) and a closed posture (refer to FIG. 1) with respect to the apparatus main body 12. By the cover 14 being in an opened posture with respect to the apparatus main body 12, it is possible for the sheet P (refer to FIGS. 7 to 9) recorded in the apparatus main body 12 to be discharged to the front surface side of the printer 10.

Next, the constituent elements of on the paper transport path will be described in further detail with reference to FIG. 2. The double-dotted and dashed line P' extending from the rear surface side (+Y axis direction side in FIG. 2) of the apparatus to the front surface side of the apparatus (−Y axis direction side in FIG. 2) in FIG. 2 indicates the transport path of the sheet P (refer to FIGS. 7 to 9). A feeding portion 16 is provided on the rear surface side (+Y direction side in FIG. 2) of the apparatus main body 12. The feeding portion 16 is provided with a hopper 18 and a feed roller 20.

The hopper 18 is configured to be able to mount sheets P on a support surface 18*a*. The hopper 18 is provided to be able to swing (+Z axis direction side in FIG. 2) with respect to the apparatus main body 12 with the upper side as a fulcrum. The hopper 18 is provided so as to be able to advance and retreat with respect to the feed roller 20. A state of swinging in a direction approaching the feed roller 20 in the hopper 18 is the feeding posture of the sheet P of the hopper 18 (refer to the double dotted and dashed portion in FIG. 2).

The edge guide provided in the hopper 18 will be described. The hopper 18 is provided with a first edge guide 46 and a second edge guide 48 that control the end portion in the X axis direction, that is, the side edge, of the sheet P mounted on the support surface 18*a* as shown in FIGS. 3, 4, and 6. The first edge guide 46 and the second edge guide 48 are arranged with respect to the X axis direction on the support surface 18*a* of the hopper 18.

The edge guides will be further described with reference to FIG. 7 schematically showing the positions thereof. From among the side edges of the sheet P, the first edge guide 46 guides the side edge SE1 on the home position side (right side in FIG. 7) of the carriage 34, and the second edge guide 48 guides the side edge SE2 of the carriage 34 on the opposite side (left side in FIG. 7) to the home position.

Although the home position of the carriage 34 is described in detail later, the home position of the carriage 34 in the embodiment is at the right end portion of FIG. 7, and the carriage indicated by the virtual line and the reference numeral 34 in FIG. 7 is shown at the home position. The carriage indicated by reference numeral 34' is shown at the end portion on the opposite side to the home position. Similarly, the reference numerals 36' and 38' are positions of the recording head (described later) and the edge detection unit (described later), respectively, when the carriage 34 is at the end portion on the opposite side to the home position.

Figure 13:
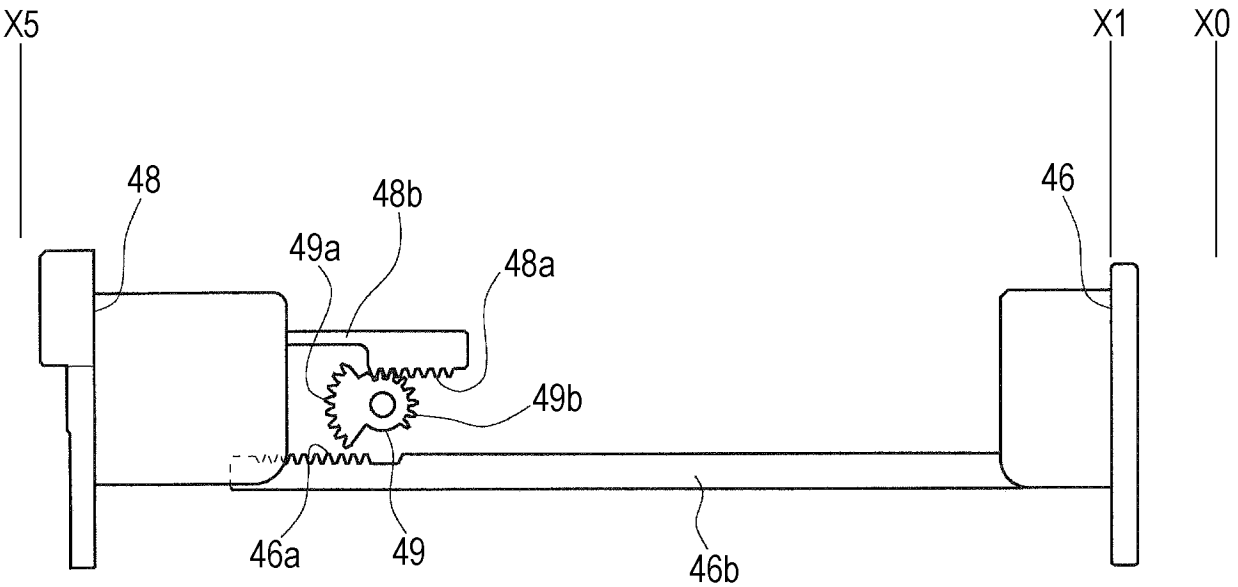
FIG. 13 is a plan view of a rack and pinion mechanism with which the first and second edge guides are interlocked.

Next, the second edge guide 48 is provided so that a user is capable of a sliding operation in the sheet width direction (X direction) according to the sheet size. In contrast, the first edge guide 46 is basically not provided on the assumption of a user performing a sliding operation. Specifically, the first edge guide 46 is provided so as to slide in synchronization with the second edge guide 48 by the rack and pinion mechanism as shown in FIGS. 12 and 13.

An arm portion 46*b* extending toward the second edge guide 48 is formed on the first edge guide 46, and a rack portion 46*a* is formed on the leading edge thereof. An arm portion 48*b* extending toward the first edge guide 46 is formed on the second edge guide 48, and a rack portion 48*a* is formed on the leading edge thereof. A pinion 49 is provided to freely rotate between the rack portion 46*a* and the rack portion 48*b*. The reference numeral 49*a* and reference numeral 49*b* indicate a first gear portion that meshes with the rack portion 46*a* in the pinion 49, and a second gear portion that meshes with the rack portion 48*a* in the pinion 49, respectively.

The first edge guide 46 is provided to be able to displace in the sheet width direction, and is imparted with frictional resistance to the sliding by a friction unit, not shown. The pinion 49 is also imparted with frictional resistance to the rotation by the friction unit, not shown.

FIG. 12 shows a state in which both of the first edge guide 46 and the second edge guide 48 are positioned to the outermost side, and, in this state, the rack portions 46*a* and 48*a* each mesh with the pinion 49. From this state, when the second edge guide 48 is slid in the right direction (direction approaching first edge guide 46) in the drawing matching the sheet size, the rack and pinion mechanism is operated, and the first edge guide 46 is displaced in a direction (left direction in drawing) approaching the second edge guide 48 in synchronization with the second edge guide 48.

However, since the rack portions 46*a* and 48*a* are formed only on one portion of the arm portions 46*a* and 48*a*, respectively, when the second edge guide 48 is slid a predetermined amount and the rack portions 46*a* and 48*a* each finish meshing with the pinion 49, as shown in FIG. 13. That is, even if the second edge guide 48 is further slid in a direction approaching the first edge guide 46, the first edge guide 46 does not slide in synchronization.

Below, when described in further detail, in a case of a sheet P with the maximum size that assumes use in the printer 10, the first edge guide 46 as shown with a solid line in FIG. 7, is positioned furthest to the home position (right side in FIG. 7), and the second edge guide 48 is positioned on the furthest side (left side in FIG. 7) from the home position. The reference symbol X0 in FIGS. 7, 12, and 13 indicates the sheet guide position due to the first edge guide 46 at this time, and the reference symbol X5 indicates the sheet guide position due to the second edge guide 48 at this time.

From this state, when the second edge guide 48 is moved to the first edge guide 46 side (right side in FIG. 7) in order to correspond to a small-sized sheet, the first edge guide 46 slides a predetermined amount in accordance with the movement of the second edge guide toward the second edge guide 48 side (inside) due to the function of the rack and pinion mechanism. The reference numeral 46' in FIG. 7 indicates the first edge guide after the slide operation is completed, and the reference symbol X1 indicates the sheet guide position due to the first edge guide 46' at this time.

When the first edge guide 46 slides a predetermined amount to the inside in this way, the rack and pinion mechanism as described above stops operation. Accordingly, even if the second edge guide 48 is slid more than this (for example, if moved from the position of reference numeral 48' (sheet guide position X4) to the position of reference numeral 48" (sheet guide position X3)), the first edge guide 46 does not move to the inside. That is, the position indicated by reference numeral 46' in FIG. 7 is maintained.

As above, in a case of a sheet P with the maximum size, the position of the side edge SE1 on the home position side is the guide position X0, and in the case of a sheet P with a smaller size, the position of the side edge SE1 on the home position side is the guide position X1. In other words, the sheet guide position on the home position differs according to the sheet size. The reason for being configured in this way is described later.

Next, the description of the configuration on the paper transport path will be continued returning to FIG. 2. A feed roller 20 driven by a driving motor, not shown, is provided at a position facing the hopper 18 in the paper transport path. When the hopper 18 swings with the upper side (+Z axis direction side in FIG. 2) as a fulcrum and adopts a paper feed posture (refer to the double dotted and dashed line part in FIG. 2), the sheet P stacked on the uppermost position on the support surface 18*a* of the hopper 18 is picked up by the feed roller 20 and is fed to the downstream side of transport path.

A transport portion 22 is provided on the downstream side of the feed roller 20 in the transport path of the sheet P. The transport portion 22 is provided with a sheet detection unit 24, a transport driving roller 26, and a transport driven roller 28. The sheet detection unit 24 is provided to freely advance and retreat with respect to the transport path of the sheet P.

When the sheet P is transported from the feeding portion 16 to the downstream side of the transport path, the sheet detection unit 24 contacts the leading edge Pf (refer to FIG. 7) of the sheet P, is pressed to the sheet P as shown with the change from the sold line to the virtual line, and rotates in the clockwise direction in FIG. 2. In so doing, the sheet detection unit 24 detects that the sheet P is transported in the transport portion 22 in the transport path, and the detection information thereof is sent to the controller 30 (refer to FIG. 9), described later. The controller 30, based on the detection information of the leading edge Pf of the sheet P of the sheet detection unit 24, is able to perform positioning (leading edge-positioning) of the leading edge Pf of the sheet P at a position facing the recording head 36 in the recording portion 32, described later.

The transport driving roller 26 is rotated by a driving source, not shown. The transport portion 22 nips the sheet P fed from the feeding portion 16 between the transport driving roller 26 and the transport driven roller 28, and transports the sheet to the downstream side in the transport direction. A recording portion 32 is provided on the downstream side of the transport portion 22.

The recording portion 32 is provided with a carriage 34, a recording head 36 provided on the bottom portion of the carriage, an edge detection unit 38 (refer to FIG. 5) provided on the bottom portion of the carriage 34, and a platen 40 that faces the recording head 36 and supports the sheet P. The recording head 36 faces the sheet P supported by the platen 40. The carriage 34 is driven to reciprocate in the main scanning direction (the front to back direction of the paper surface, that is, the X axis direction, in FIG. 2) as the "predetermined direction" by a driving motor, not shown, controlled by the controller 30 (refer to FIG. 9) provided on the interior of the apparatus main body 12.

The platen 40 regulates the distance (gap) between the recording surface of the sheet P and the head surface of the recording head 36 by supporting the sheet P from beneath. A plurality of nozzle holes (not shown) is provided on the surface facing the sheet P of the recording head 36, and recording is executed on the sheet P by ink being discharged from the nozzle holes toward the recording surface of the sheet P.

A discharge portion 42 is provided on the downstream side of the recording portion 32 in the transport direction. The discharge portion 42 includes a discharge driving roller 44. The sheet P on which recording is executed by the recording portion 32 is discharged toward the front of the apparatus by a discharge driving roller 44. The discharge driving roller 44 is rotated by a driving source, not shown.

Next, the mechanism by which the carriage 34 in the recording portion 32 will be described. The recording portion 32 is further provided with a carriage driving mechanism 50 with which the carriage 34 is moved in the X axis direction in FIG. 3, and a carriage driving motor 52 with which the carriage driving mechanism is driven. The carriage driving motor 52 is attached to the end portion on the +X axis direction side of the frame 54 extending in the X axis direction in the apparatus main body 12.

The carriage driving mechanism 50 is provided with a driving pulley 56, a driven pulley (not shown), and a timing belt 58. The driving pulley 56 is attached to the drive shaft of the carriage driving motor 52. The driven pulley, not shown, is attached to be able to be driven to rotate with respect to the driving pulley 56 on the −X axis direction side of the frame 54. The timing belt 58 is wrapped on the driving pulley 56 and the driven pulley, not shown.

A portion of the timing belt 58 is held and supported by the carriage 34. Accordingly, when the carriage driving motor 52 is rotatably driven, the timing belt 58 is driving via the driving pulley 56, and the carriage 34 moves in the X axis direction. The carriage driving mechanism 50 and the carriage driving motor 52 are controlled by the controller 30 as shown in FIG. 8.

Next, a linear scale 61 (refer to FIG. 3) extending along the X axis direction is provided on the frame 54. An encoder sensor 63 (refer to FIG. 9) is provided on the rear surface side of the carriage 34. The encoder sensor 63 is configured to be able to detect the linear scale 61. The encoder sensor 63 will be further described later.

Next, a signal line cable 60 as shown in FIGS. 3 and 4 is connected to the side surface of the +X direction side of the carriage 34 (in FIG. 6, the signal line cable 60 is not shown). The signal line cable 60 is configured as a flexible flat cable (FFC) in one example. The other end side of the signal line cable 60 is connected to the controller 30 once fixed to the frame 62.

The signal line cable 60 is curled inside the region in which the carriage 34 is movable and connected to the carriage 34. In other words, the signal line cable 60 extends from the side surface on the +X direction side of the carriage 34 to the +X direction side in the movable region L. The signal line cable 60 is deformed following the movement operation of the carriage 34.

Although the curled part is positioned on the paper transport path as shown in FIG. 4 in a state in which the carriage 34 is positioned at the home position, when the carriage 34 moves to the opposite side (left end in FIG. 4) to the home position, the signal line cable 60 retreats from the paper transport path (not shown).

Next, the configuration of the carriage 34 will be further described with reference to FIG. 5. The carriage 34 in the example is formed in a box shape, and an ink cartridge 64 (refer to FIG. 3) is attached to the upper surface side to be replaceable from the +Z axis side. The recording head 36 and the edge detection unit 38 are provided on the bottom portion of the carriage 34.

The edge detection unit 38 is positioned on the +X axis side in FIG. 5 with respect to the recording head 36 and arranged close to the end portion on the +Y axis side of the carriage 34. The edge detection unit 38 in the example is configured as one example of a reflection-type optical detection device.

The detection position in the X axis direction of the edge detection unit 38 is the inside of the sheet passing region W (region between the guide position X0 and the guide position X5) when the first edge guide 46 as shown in FIG. 7 is positioned to the outermost side (home position side) (guide position X0 in FIG. 7). This will be described in detail later.

A sliding portion 66 is provided on the end portion on the −Y direction side of the carriage 34. Sliding portions 68 and 68 are provided on the end portion on the +Y direction side of the carriage 34. Again referring to FIG. 4, a guide 70 is provided on the frame 54 side along the region L in which the carriage 34 is movable, and a guide 72 is provided on the frame 62 side.

When the carriage 34 moves due to the carriage driving mechanism 50 in the X axis direction within the movable region L, the sliding portion 66 of the carriage 34 slides on the guide 72, and the sliding portions 68 and 68 slide on the guide 70.

Incidentally, in a case where the carriage 34 is positioned to the rightmost end (end portion on the −X axis side) in the drawings in the movable range of the carriage 34, the reference symbol L0 in FIGS. 4, 6, and 7 indicates the position of the right side wall of the carriage 34. Similarly, in a case where the carriage 34 is positioned to the left most end (end portion on the +X axis side) in the drawings in the movable range of the carriage 34, the reference symbol L2 indicates the position of the left side wall of the carriage 34. The carriage 34 is able to move in the range (movable region L) of the position L0 and the position L2.

A capping unit 74 that caps the recording head 36 provided on the carriage 34 is provided as shown in FIG. 6 outside the passing region of the sheet P that is the region on the −X axis direction side of the region in which the carriage 34 is movable. The capping unit 74 suppresses drying of the ink in the plurality of nozzle rows provided in the recording head 36 by capping the recording head 36, and is thus able to suppress nozzle clogging. The position of the carriage 34 when the capping unit 74 caps the recording head 36 is the home position as the "predetermined position" of the carriage 34, and the right side wall of the carriage 34 at the home position is positioned slightly further to the inside (left side in FIGS. 4, 6, and 7) than the position L0.

Next, the control system of the printer 10 will be described with reference to FIG. 8. The carriage 34 is driving by a CR (carriage) motor 52 as described above. An encoder sensor 63 is provided on the carriage 34. The encoder sensor 63 is configured provided with a light emitting portion (not shown) and a light sensing portion (not shown), and the linear scale 61 extending along the X axis direction is provided so as to be interposed by the light emitting portion and the light sensing portion. Accompanying the movement of the carriage 34, the encoder sensor 63 transmits a rectangular wave signal accompanying the passage of the plurality of slits formed in the linear scale 61 to the controller 30 as a control unit, and, in so doing, the controller 30 is able to detect the position and speed in the main scanning direction of the carriage 34.

Next, the transport portion 22 is driven by the PF motor 75. A disk-shaped rotary scale (not shown) that configures the rotary encoder 76 is provided in the driving target, for example, the transport driving roller 26, driven to rotate by the PF motor 75. The rotary encoder 76 is provided with a light emitting portion (not shown) and a light sensing portion (not shown), and the rotary scale is provided so as to be interposed by the light emitting portion and the light sensing portion. Accompanying the rotation of the PF motor 75, the rotary encoder 76 a rectangular wave signal accompanying the passage of the plurality of slits formed in the rotary scale to the controller 30 as a control unit, and, in so doing, the controller 30 is able to detect the rotation amount and the rotation speed of the driving target driven by the transport driving roller 26 or other PF motor 75.

The controller 30 detects the passing of the sheet P based on the detection signal transmitted from the sheet detection unit 24, and performs any necessary control. The controller 30 is further able to ascertain the presence of passing under the edge detection unit 38 of the sheet P using the signal information received from the edge detection unit 38 and to ascertain the edge position (leading edge, trailing edge position, side edge position) of the sheet P.

The RAM 78, ROM 79, ASIC 77, CPU 81, and EEPROM (nonvolatile memory) 80 are connected to the system bus of the controller 30.

Output signals of a power switch (not shown) for turning the power source of the rotary encoder 76, encoder sensor 63, sheet detection unit 24, and printer 10 on and off or various other setting buttons (not shown) is input to the CPU 81 via the ASIC 77. The CPU 81 performs calculation processing for executing recording control of the printer 10 or other necessary calculation processing based on the output signals or the like of each type of sensor or switch.

A recording control program (firmware) or the like necessary to the control of the printer 10 by the CPU 81 is stored in the ROM 79, and various data and the like necessary in the processing of the recording control program are stored in the EEPROM 80. The RAM 78 is used as work region for the CPU 81 or a temporary storage region for recording data or the like.

The ASIC 77 includes a control circuit for performing rotation control of the PF motor 75 that is a DC motor and the CR motor 52 and driving control of the recording head 36. The reference symbol 83 is the CR controller that performs rotation control of the CR motor 52, based on the pulse signal (pulse period) output from the encoder sensor 63, and the CR controller 83 calculates the present speed of the carriage 34, and performs PID control (feedback control) on the driving of the CR motor 52 for each minute time period (control step. Also referred to as a PID control period) so that the speed follows a speed profile set in advance.

The PF controller 84 calculates the present rotation speed (value compared to the rotation amount) of the transport driving roller 26, based on the pulse signal (pulse period) output from the rotary encoder 76, and performs PID control (feedback control) on the driving of the PF motor 75 so that the speed follows a speed profile set in advance.

The CR motor driver 86 generates the PWM signal as a pulse by pulse-width modulation on the direct current as the power source voltage according to the duty ratio DR (ratio of ON time period with respect to the pulse period) and outputs the signal to the CR motor 52. The CR motor 52 is a DC motor, and rotates the PWM signal output from the CR motor driver 30 as the driving power source. The same applies to the relationship between the PF motor driver 85 and the PF motor 75.

The ASIC 77 performs driving control on the recording head 36 by calculating and generating the control signal of the recording head 36, based on the recording data transmitted from the CPU 81, and sending the signal to the head driver 87. The ASIC 77 further includes an IF 82 that realizes information transfer with the external computer 90 and the like as an information processing apparatus.

Control During Recording Execution

Control during recording execution in the printer 10 provided with the above configuration will be described with reference to FIG. 9 and other drawings. Firstly, when a recording execution command is sent by a user, the controller 30 references the sheet size information included in the printing settings information (driver information) (Step S101), and divides control between a case in which the sheet width is a predetermined width (maximum size), that is, a case where it is possible to estimate that the first edge guide 46 is at the guide position X0 in FIG. 7, and a case in which the sheet width is less than a predetermined width, that is, a case where it is possible to estimate that the first edge guide 46 is at the guide position X1 in FIG. 7. At the start point of the printing job, the carriage 34 is positioned at the home position that is an example of the predetermined position.

Below, a case where the sheet width is the predetermined width (maximum size), that is, a case where it is possible to estimate that the first edge guide 46 is at the guide position X0 in FIG. 7 from the sheet size information, will be described. In this case, when the sheet is fed (Step S102), if the first edge guide 46 is correctly at the guide position X0, the sheet P, as clarified in FIG. 7, passes under the edge detection unit 38. That is, it is possible to detect the leading edge of the sheet (Yes in Step S103). FIG. 10 shows the state at this time. Assuming a case where the leading edge of the sheet is not detected, because it is possible to determine that a paper jam has occurred, or that the position of the first edge guide 46 or the sheet size is inappropriate, an error process is performed (No in Step S103).

In a case in which the leading edge of the sheet is detected, it is determined whether or not the borderless recording is performed from the information included in the printing settings information (driver information) (Step S104). In a case of the borderless recording (Yes in Step S104), the printing process is not supported and an error process is performed. In a case of not performing the borderless recording (No in Step S104), the carriage 34 is moved to the non-home position side, and the position of the side edge SE2 on the non-home position side is detected (Step S105). The position detection of the sheet side edge in the embodiment is performed when the edge detection unit 38 traces the edge from the inside of the sheet to the outside.

Next, the carriage 34 is moved to the end portion position on the non-home position side (Step S110). FIG. 11 shows the state at this time. Next, when moving to the home position side, first recording is performed (Step S111).

Next, a case where the sheet width is less than the predetermined width (maximum size), that is, a case where it is possible to estimate that the first edge guide 46 is at the guide position X1 in FIG. 7 from the sheet size information, will be described. In this case, when the sheet is fed (Step S106), if the first edge guide 46 is correctly at the guide position X1, the sheet P, as clarified in FIG. 7, passes under the edge detection unit 38. That is, the leading edge of the sheet is not detected (No in Step S107). Assuming a case where the leading edge of the sheet is detected, because it is possible to determine the first edge guide 46 not correctly moving to the guide position X1, an error process is performed (Yes in Step S107).

Next, detection of the side edge SE1 on the home position side is performed (Step S108), and then detection of the side edge SE2 ion the non-home position side is performed (Step S109). Position detection of the sheet side edges SE1 and SE2 at this time are also performed by the edge detection unit 38 tracing the edge from the inside of the sheet to the outside, as described above. Step S110 onwards are as already described.

Below, the actions and effect of the printer 10 configured as above will be described. In a state where the carriage 34 is positioned at the predetermined position, that is, at the home position in the example, the edge detection unit 38 is positioned within the passing region W of the sheet P in the X axis direction that is the movement direction of the carriage 34 as shown in FIG. 7. Accordingly, the home position of the carriage 34 attains a state close to the passing region W side of the sheet P. Accordingly, in so doing, the horizontal width dimensions (dimensions in the X axis direction) of the apparatus are suppressed, it is possible for the size of the apparatus to be reduced.

In the embodiment, although the predetermined position of the carriage 34 is the home position and the position where the recording head 36 is capped by the capping unit 74, there is no limitation thereto, and the predetermined position is preferably the end portion position (case where the right side wall of the carriage 34 in FIG. 7 is positioned at the position L0) on one side in the movement region of the carriage 34.

In the embodiment, the leading edge detection mode (corresponds to Steps S102 and S103 in FIG. 9) for detecting the leading edge Pf is executed, by transporting the leading edge Pf of the sheet P until passing through a position facing the edge detection unit 38 in a state where the carriage 34 is stopped at the predetermined position (home position) during leading edge-positioning of the sheet P (corresponds to Step S102 in FIG. 9).

Accordingly, it is possible to detect the passing of the leading edge Pf of the sheet with the carriage 34 stopped as is at the predetermined position (home position), that is, it is possible to suppress a lowering of the recording throughput without it being necessary for the carriage 34 to be moved from the predetermined position (home position) to the detection position.

In the embodiment, the controller 30 does not perform the borderless recording that performs recording without white space on the end portion of the sheet P (Yes in Step S104 in FIG. 9), in a case where the leading edge detection mode is executed. That is, in a case where only the side edge SE2 on one side of the sheet P is detected (case where side edge SE1 on the other side is not detected), since the borderless recording in which recording position shifts are easily visible is not executed, it is possible to ensure a suitable recording quality.

The controller 30 executes the side edge detection mode for detection the side edge SE2 on one side of the sheet P (corresponds to Step S105 in FIG. 9) by the carriage 34 being moved to the non-home position side until the edge detection unit 38 is separated from the region of the sheet P after execution of the leading edge detection mode. In this way, by detecting the side edge SE2 on one side, recording position shifts are suppressed and it is possible to obtain better recording results.

In the embodiment, the signal line cable 60 extends from the side surface of the carriage 34 on the opposite side to the home position, and the controller 30 performs first recording on the sheet P with the recording head 36 (corresponds to Steps S110 and S111 in FIG. 9) when the carriage 34 is moved toward the home position side after the side edge detection mode is executed.

In so doing, the actions and effects are as described below. That is, in a case where the signal line cable 60 extends from the side surface of the carriage 34 on the opposite side to the home position side, when the carriage 34 is positioned at the home position, a state is attained where the signal line cable 60 is positioned at the upper portion of the sheet transport region as shown in FIG. 4. Accordingly, in this case, it is difficult to perform jam processing tasks in a case in which a jam occurs in the sheet transport path and there is concern of a breakdown occurring by the user touching the signal line cable 60.

Meanwhile, when the carriage 34 is positioned at the end portion on the opposite side (below, referred to as "opposite side end portion position") to the home position side, the signal line cable 60 retreats from the upper portion of the sheet transport region.

Here, there is concern of the recording head 36 coming into contact with the side edges SE1 and SE2 as the side edges SE1 and SE2 of the sheet P moves upward and a jam arising as a result. That is, the jam accompanying the movement of the carriage 34 easily occur when the recording head 36 moves from the outside of the sheet P towards the inside during first recording on the sheet P.

In a case in which the first recording on the sheet P is performed from the home position side of the carriage 34, when a jam occurs in this step, the carriage 34 is able to undertake only one of stopping at the position or returning to the home position. Thus, because the signal line cable 60 is positioned on a position above the sheet transport region as shown in FIG. 4 during jam processing tasks by the user, there is concern of the above-described problem arising.

However, since the controller 30 performs first recording with the recording head 36 when the carriage 34 is moved from the end portion on the opposite side to the home position towards the home position after the side edge detection mode is executed (Steps S110 and S111 in FIG. 9), in this case, because if a jam occurs, the carriage 34 is positioned at the end portion on the opposite side to the home position, the signal line cable 60 retreats from the upper portion of the sheet transport region as a result, it is possible for the problem to be avoided.

In the embodiment, first edge guide 46 is movable to the second edge guide 48 side until the sheet passing region is separated from the arrangement position of the edge detection unit 38 in a state in which the carriage 34 is positioned at the home position (guide position X1 in FIG. 7).

Accordingly, by moving the first edge guide 46 to the guide position X1 in FIG. 7, it is possible for the side edge SE1 on the home position side of the sheet P to be detected by the edge detection unit 38. That is, since it is possible to detect the side edge on both sides of the sheet P, shifting of the recording position is more reliably suppressed, and it is possible for a better recording result to be obtained. In particular, during the borderless recording, an excellent recording result is obtained with suppression of shifting of the recording position.

When the second edge guide 48 is moved toward the first edge guide 46 side, the first edge guide 46 in the embodiment moves in accordance with the movement of the second edge guide in a direction toward the second edge guide 48 with the predetermined guide position as a boundary. In the embodiment, when the second edge guide 48 is moved from the guide position X5 to the right side in FIG. 7, because the first edge guide 46 is interlocked, the predetermined guide position is the guide position X5 in FIG. 7.

In this way, in the embodiment, since the first edge guide 46 moves in accordance with the movement of the second edge guide 48, the operability for the user is improved.

In the embodiment, although a user operates the second edge guide 48 on the left side when viewed from the front of the apparatus to slide, and the first edge guide 46 on the right side of the apparatus slides and displaces with the rack and pinion mechanism according to the operation, the configuration may be reversed. In the embodiment, the apparatus is preferably configured such that the user operates the first edge guide 46 on the right side when viewed from the front of the apparatus to slide, and the second edge guide 48 on the left side of the apparatus slides and displaces with the rack and pinion mechanism, according to the operation. That is, the configuration shown in FIGS. 12 and 13 is preferably made a form in which left and right are mirrored.

In the embodiment, although the edge detection unit 38 according to the invention is applied to an ink jet printer as an example of the recording apparatus, application is generally also possible to other liquid ejecting apparatuses. The liquid ejecting apparatus is not limited to a recording apparatus such as a printer, copy machine and fax machine in which an ink jet type recording head is used and which performs recording on a recording medium by ejecting ink from the recording head, and includes an apparatus ejecting, in place of ink, a liquid corresponding to other uses from a liquid ejecting head corresponding to an ink jet recording head to an ejection medium corresponding to a recording medium, and the liquid is applied to the ejection medium.

In addition to the recording head, examples of the liquid ejecting head include a coloring material ejecting head used in the manufacturing of a color filter for a liquid crystal display or the like, an electrode material (conductive paste) ejecting head used in electrode formation of an organic EL display, a field emission display (FED), or the like, a bio-organic ejecting head used in biochip manufacturing, or a sample ejecting head as a precision pipette.

The invention is not limited to the embodiments described above and may be modified in various ways within the aspects described in claims, and the modifications should be construed as being included in the invention.

The entire disclosure of Japanese Patent Application No. 2014-34381, filed Feb. 25, 2014 is expressly incorporated by reference herein.

What is claimed is:

1. A recording apparatus comprising:

a carriage that includes a recording head performing recording on a recording medium, and an edge detection unit detecting an edge of the recording medium and is movable along a movable range of the carriage in a predetermined direction, wherein, in a state in which the carriage is positioned at a predetermined position, the edge detection unit is positioned in a passing region of the recording medium in the movement direction of the carriage, and the predetermined position is a home position of the carriage, wherein the predetermined position is an endmost position on one side of the moveable range of the carriage.

2. The recording apparatus according to claim 1, further comprising:

a transport unit that transports the recording medium; and a control unit that controls the transport unit and the carriage, wherein the control unit is able to execute a leading edge detection mode for detecting a leading edge of the recording medium by transporting the recording medium until the leading edge of the recording medium passes through a position facing the edge detection unit, in a state in which the carriage is stopped at the predetermined position during leading edge-positioning of the recording medium.

3. The recording apparatus according to claim 2, wherein the control unit, in a case where the leading edge detection mode is executed, does not execute borderless recording that performs recording without white space on the end portion of the recording medium.

4. The recording apparatus according to claim 3, wherein, after the leading edge detection mode is executed, the control unit executes a side edge detection mode for detecting the side edge of one side of the recording medium by the carriage being moved to an opposite side to the predetermined position side until the edge detection unit is separated from the region of the recording medium.

5. The recording apparatus according to claim 4, wherein a signal line cable that connects the control unit and the recording head extends from the side surface of the carriage on the opposite side to the predetermined position side, and the control unit performs first recording on the recording medium with the recording head when the carriage is moved toward the predetermined position after execution of the side edge detection mode.

6. The recording apparatus according to claim 5, further comprising:

a feeding portion that feeds the recording medium to the recording head side, wherein the feeding portion includes a first edge guide that guides the side edge of the recording medium on the predetermined position side in a direction that intersects a feeding direction of the recording medium, and a second edge guide that guides the side edge of the recording medium on an opposite side to the predetermined position side, and wherein the first edge guide is provided to be movable to the second edge guide side until the passing region of the recording medium is separated from the arrangement position of the edge detection unit in a state in which the carriage is positioned at the predetermined position.

7. The recording apparatus according to claim 6, wherein the second edge guide is provided to be able to advance and retreat with respect to the first edge guide, and the first edge guide is provided to be movable in accordance with a movement of the second edge guide in a direction toward the second edge guide with a predetermined guide position as a boundary when the second edge guide is moved toward the first edge guide side.

8. A recording apparatus, comprising:

a carriage that includes a recording head performing recording on a recording medium, and an edge detection unit detecting an edge of the recording medium and is movable along a movable range of the carriage in a predetermined direction; and a cap unit that caps the recording head and is provided outside a passing region of the recording medium in the movement direction of the carriage, wherein in a state in which the carriage is positioned at a predetermined position, the edge detection unit is positioned in the passing region of the recording medium in the movement direction of the carriage, and the predetermined position is a position at which the recording head is capped by the cap unit, wherein the predetermined position is an endmost position on one side of the moveable range of the carriage.

9. A recording apparatus comprising:

a carriage that includes a recording head performing recording on a recording medium, and an edge detection unit detecting an edge of the recording medium, and is movable along a movable range of the carriage in a predetermined direction, wherein, in a state in which the carriage is positioned at a predetermined position, the edge detection unit is positioned in a passing region of the recording medium in the movement direction of the carriage, and the predetermined position is an end portion position on one side of the movable region of the carriage.

10. A recording apparatus comprising:

a carriage that includes a recording head performing recording on a recording medium, and an edge detection unit detecting an edge of the recording medium and is movable in a predetermined direction;

a transport unit that transports the recording medium; and a control unit that controls the transport unit and the carriage, wherein, in a state in which the carriage is positioned at a predetermined position, the edge detection unit is positioned in a passing region of the recording medium in the movement direction of the carriage, and the predetermined position is a home position of the carriage, wherein the control unit is able to execute a leading edge detection mode for detecting a leading edge of the recording medium by transporting the recording medium until the leading edge of the recording medium passes through a position facing the edge detection unit, in a state in which the carriage is stopped at the predetermined position during leading edge-positioning of the recording medium, and wherein the control unit, in a case where the leading edge detection mode is executed, does not execute borderless recording that performs recording without white space on the end portion of the recording medium.

11. A recording apparatus, comprising:

a carriage that includes a recording head performing recording on a recording medium, and an edge detection unit detecting an edge of the recording medium and is movable in a predetermined direction;

a transport unit that transports the recording medium;

a control unit that controls the transport unit and the carriage, and a cap unit that caps the recording head and is provided outside a passing region of the recording medium in the movement direction of the carriage, wherein in a state in which the carriage is positioned at a predetermined position, the edge detection unit is positioned in the passing region of the recording medium in the movement direction of the carriage, and the predetermined position is a position at which the recording head is capped by the cap unit, wherein the control unit is able to execute a leading edge detection mode for detecting a leading edge of the recording medium by transporting the recording medium until the leading edge of the recording medium passes through a position facing the edge detection unit, in a state in which the carriage is stopped at the predetermined position during leading edge-positioning of the recording medium, and wherein the control unit, in a case where the leading edge detection mode is executed, does not execute borderless recording that performs recording without white space on the end portion of the recording medium.

12. A recording apparatus comprising:

a carriage that includes a recording head performing recording on a recording medium, and an edge detection unit detecting an edge of the recording medium, and is movable in a predetermined direction;

a transport unit that transports the recording medium; and a control unit that controls the transport unit and the carriage, wherein, in a state in which the carriage is positioned at a predetermined position, the edge detection unit is positioned in a passing region of the recording medium in the movement direction of the carriage, and the predetermined position is an end portion position on one side of the movable region of the carriage, wherein the control unit is able to execute a leading edge detection mode for detecting a leading edge of the recording medium by transporting the recording medium until the leading edge of the recording medium passes through a position facing the edge detection unit, in a state in which the carriage is stopped at the predetermined position during leading edge-positioning of the recording medium, and wherein the control unit, in a case where the leading edge detection mode is executed, does not execute borderless recording that performs recording without white space on the end portion of the recording medium.

* * * * *